US007720401B2

(12) United States Patent
Domoto et al.

(10) Patent No.: US 7,720,401 B2
(45) Date of Patent: May 18, 2010

(54) INTER-DOCUMENT ZONE GLOSS DEFECT ELIMINATOR

(75) Inventors: Gerald A Domoto, Briarcliff Manor, NY (US); Nicholas Kladias, Flushing, NY (US); Barry P Mandel, Fairport, NY (US); Augusto Barton, Webster, NY (US); Yongsoon Eun, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 281 days.

(21) Appl. No.: 11/877,714

(22) Filed: Oct. 24, 2007

(65) Prior Publication Data

US 2009/0110426 A1 Apr. 30, 2009

(51) Int. Cl.
*G03G 15/20* (2006.01)
*G03G 15/00* (2006.01)

(52) U.S. Cl. ..... 399/68; 399/322; 399/400

(58) Field of Classification Search ..... 399/67, 399/68, 322, 400, 341
See application file for complete search history.

(56) References Cited

U.S. PATENT DOCUMENTS

| | | | | |
|---|---|---|---|---|
| 5,239,348 | A * | 8/1993 | Fukuchi et al. | 399/400 |
| 6,505,832 | B2 | 1/2003 | Moore et al. | |
| 6,577,845 | B2 * | 6/2003 | Stevens | |
| 6,832,059 | B2 * | 12/2004 | Fujiwara | |
| 7,065,309 | B2 * | 6/2006 | Sato | 399/67 |
| 7,260,339 | B2 * | 8/2007 | Carter et al. | 399/68 |
| 2003/0059280 | A1 * | 3/2003 | Stevens | |

FOREIGN PATENT DOCUMENTS

JP 06056299 A * 3/1994

* cited by examiner

*Primary Examiner*—Susan S Lee
(74) *Attorney, Agent, or Firm*—Lloyd F. Bean, II

(57) ABSTRACT

A method for reducing gloss variation in prints, in an electrostatic printing system having a fuser for fusing sheets having marking particles thereon, the method including transporting a first sheet to the fuser; transporting a second sheet to the fuser; and abutting a trailing edge of the first sheet to a leading edge of the second sheet prior to the trailing edge of the first sheet entering the fuser.

11 Claims, 4 Drawing Sheets

INTER-DOCUMENT ZONE GLOSS DEFECT ELIMINATOR

BACKGROUND

The present disclosure relates generally to an electrostatographic or xerographic printing machine, and more particularly concerns a fixing device and a fixing method of forming an unfixed toner image of an image pattern corresponding to objective image information on a surface of a recording media.

In a typical electrostatographic reproduction process machine, a photoconductive member is charged to a substantially uniform potential so as to sensitize the surface thereof. The charged portion of the photoconductive member is imagewise exposed in order to selectively dissipate charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated at a thermal fusing apparatus at a desired operating temperature so as to fuse and permanently affix the powder image to the copy sheet having a certain gloss. In recent years, in particular, for a full-color image, a demand for an enhancement of image quality by making the image glossy has been increased. It is highly desirable to have printed images with uniform gloss throughout the entire sheet.

Fuser gaps exist between consecutive sheets of paper (inter-document zone or IDZ). Applicants have found in a print job consisting of many sheets of paper, if the fusers are asynchronous with the page stream, IDZs create hot zones on the fuser which come around and create high temperature zones within the sheets of paper that come in contact with them. These step changes in the paper temperature and previously fused image contact with the fusers can lead to gloss variations (gloss non-uniformity) that are very obvious to the human eye due to the abrupt nature of the temperature change in the process direction. A conventional solution to this problem is to operate only at fuser temperatures where gloss is independent of temperature. This is not feasible when a lower gloss level is desired.

It is desirable to have a simple apparatus construction which can generate images with high glossiness and is free from gloss non-uniformity.

SUMMARY

There is provided a method for reducing gloss variation in prints, in an electrostatic printing system having a fuser for fusing sheets having marking particles thereon, the method including transporting a first sheet to the fuser; transporting a second sheet to the fuser; and abutting a trailing edge of the first sheet to a leading edge of the second sheet prior to the trailing edge of the first sheet entering the fuser.

BRIEF DESCRIPTION OF THE DRAWINGS

Other features of the present invention will become apparent as the following description proceeds and upon reference to the drawings, in which.

DETAILED DESCRIPTION

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

In as much as the art of electrophotographic printing is well known, the various processing stations employed in the FIG. 1 printing machine will be shown hereinafter schematically and their operation described briefly with reference thereto.

Figure 1:
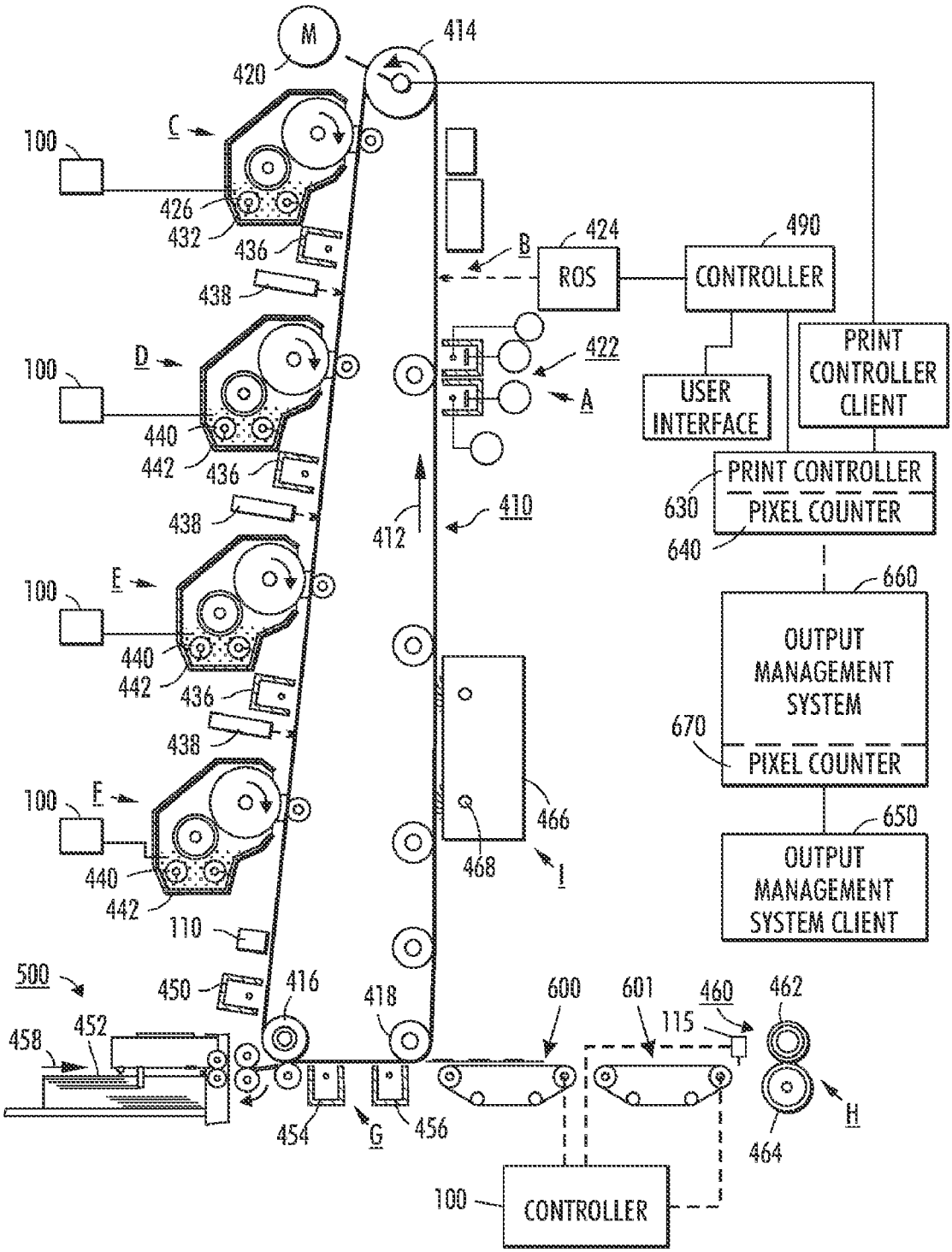
FIG. 1 is a schematic of an example of a digital imaging system, which can employ the media transport of the present disclosure.

FIG. 1 is a partial schematic view of a digital imaging system, such as the digital imaging system of U.S. Pat. No. 6,505,832 which is hereby incorporated by reference. The imaging system is used to produce color output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system, and a black and white printing system.

Referring to FIG. 1, an Output Management System 660 may supply printing jobs to the Print Controller 630. Printing jobs may be submitted from the Output Management System Client 650 to the Output Management System 660. A pixel counter 670 is incorporated into the Output Management System 660 to count the number of pixels to be imaged with toner on each sheet or page of the job, for each color. The pixel count information is stored in the Output Management System memory. The Output Management System 660 submits job control information, including the pixel count data, and the printing job to the Print Controller 630. Job control information, including the pixel count data, and digital image data are communicated from the Print Controller 630 to the Controller 490.

The printing system preferably uses a charge retentive surface in the form of an Active Matrix (AMAT) photoreceptor belt 410 supported for movement in the direction indicated by arrow 412, for advancing sequentially through the various xerographic process stations. The belt is entrained about a drive roller 414, tension roller 416 and fixed roller 418 and the drive roller 414 is operatively connected to a drive motor 420 for effecting movement of the belt through the xerographic stations. A portion of belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from Print Controller 630 representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage V0, undergoes dark decay to a level equal to about −500 volts. When exposed at the exposure station B, it is discharged to a level equal to about −50 volts. Thus after exposure, the photoreceptor belt 410 contains a monopolar voltage profile of high and low voltages, the former corresponding to charged areas and the latter corresponding to discharged or developed areas.

At a first development station C, developer structure, indicated generally by the reference numeral 432 utilizing a hybrid development system, the developer roller, better known as the donor roller, is powered by two developer fields (potentials across an air gap). The first field is the AC field which is used for toner cloud generation. The second field is the DC developer field which is used to control the amount of developed toner mass on the photoreceptor belt 410. The toner cloud causes charged toner particles to be attracted to the electrostatic latent image. Appropriate developer biasing is accomplished via a power supply. This type of system is a non-contact type in which only toner particles (black, for example) are attracted to the latent image and there is no mechanical contact between the photoreceptor belt 410 and a toner delivery device to disturb a previously developed, but unfixed, image. A toner concentration sensor 200 senses the toner concentration in the developer structure 432.

The developed but unfixed image is then transported past a second charging device 436 where the photoreceptor belt 410 and previously developed toner image areas are recharged to a predetermined level.

A second exposure/imaging is performed by device 438 which comprises a laser based output structure is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels, and toned and untoned areas at relatively low voltage levels. These low voltage areas represent image areas which are developed using discharged area development (DAD). To this end, a negatively charged, developer material 440 comprising color toner is employed. The toner, which by way of example may be yellow, is contained in a developer housing structure 442 disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles. Further, a toner concentration sensor 200 senses the toner concentration in the developer housing structure 442.

The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 1, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with photoconductive surface of photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detack dicorotron 456 is provided for facilitating stripping of the sheets from the photoreceptor belt 410.

After transfer, the sheet of support material 452 continues to move, in the direction of arrow 458, onto a conveyor 600 and 601 of the present disclosure which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and backup roller 464 with the toner powder image contacting fuser roller 462. In this manner, the toner powder images are permanently affixed to sheet 452. After fusing, a chute, not shown, guides the advancing sheet 452 to a catch tray, stacker, finisher or other output device (not shown), for subsequent removal from the printing machine by the operator.

After the sheet of support material 452 is separated from photoconductive surface of photoreceptor belt 410, the residual toner particles carried by the non-image areas on the photoconductive surface are removed therefrom. These particles are removed at cleaning station I using a cleaning brush or plural brush structure contained in a housing 466. The cleaning brushes 468 are engaged after the composite toner image is transferred to a sheet.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets.

It is believed that the foregoing description is sufficient for purposes of the present application to illustrate the general operation of an electrophotographic printing machine incorporating the development apparatus of the present disclosure therein.

Figure 2:
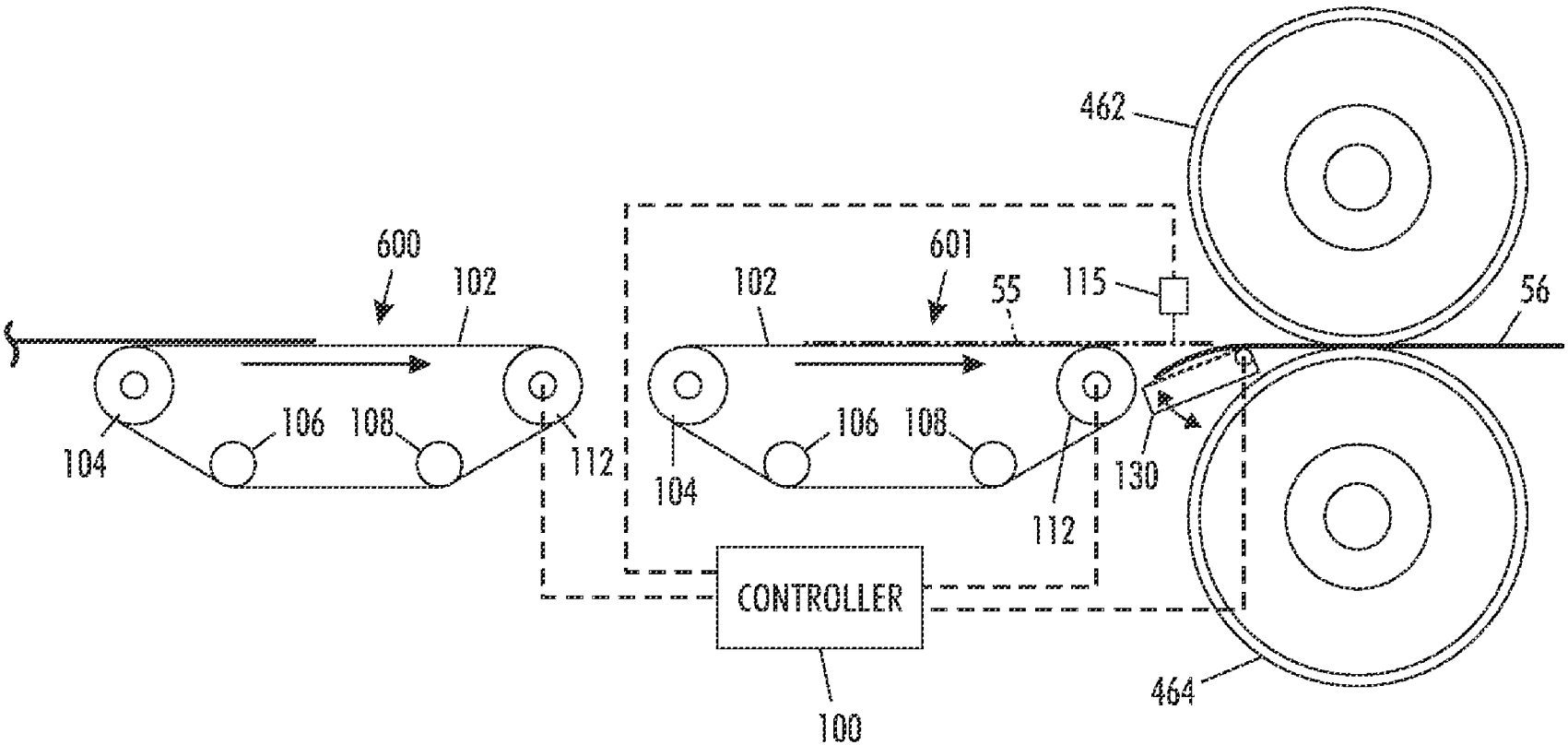
FIG. 2 is a schematic of an embodiment of a media transport of the present disclosure.

Now focusing on the embodiments of the present disclosure referring to FIG. 2.

Paper transport modules 600 and 601 preferably uses belt 102 supported for movement in the direction indicated by arrows. The belt of paper transport modules 600 is entrained about a drive roller 112, tension roller 108 and fixed rollers 104 and 106, the drive roller 112 being operatively connected to a drive motor. The belt of paper transport module 601 is entrained about a drive roller 112, tension roller 108 and fixed rollers 104 and 106, the drive roller 112 being operatively connected to a drive motor.

Controller 100 controls the operation of paper transport modules 600 and 601. In one mode of operation controller 100 controls paper transport modules 600 and 601 so that a first sheet 56 to the fuser is transported and a second sheet 55 to the fuser is transported with the trailing edge of the first sheet 56 abutting the leading edge of the second sheet 55 prior to the trailing edge of the first sheet 56 entering the fuser.

Controller 100 may employ a sensor 115 for sensing trailing edge of the first sheet 56 and leading edge of the second sheet 55 whereupon controller 100 varies the speed of the second sheet 55 and/or the speed of the first sheet 56, in response to sensor 115, so that the trailing edge of the first sheet 56 and the leading edge of the second sheet 55 abut each other prior to the trailing edge of the first sheet 56 entering the fuser.

Controller 100 controls the sheet transported on paper transport modules 600 and 601 so that the trailing edge of the first sheet and the leading edge of the second sheet have a predefined overlap, where preferably this predefined overlap is between 1 mm to 5 mm. Then the first sheet is accelerated to a higher speed after exiting the Riser to provide separation between the first sheet and the second sheet.

To facilitate a slight overlap with the sheet already in the fuser, a short vacuum plate 130 is located just before the fuser to deflect the trail edge of the sheet in the fuser and enable this overlap without stubbing. With most media (and if designed with adequate flow), this vacuum plate 130 could be left in a stationary position. For the stiffest media this plate could optionally be rotated up to contact the media which assists in sheet acquisition, then moved down slightly to allow sheet overlap. Vacuum plate 130 operation is controlled by controller 100.

Figure 3:
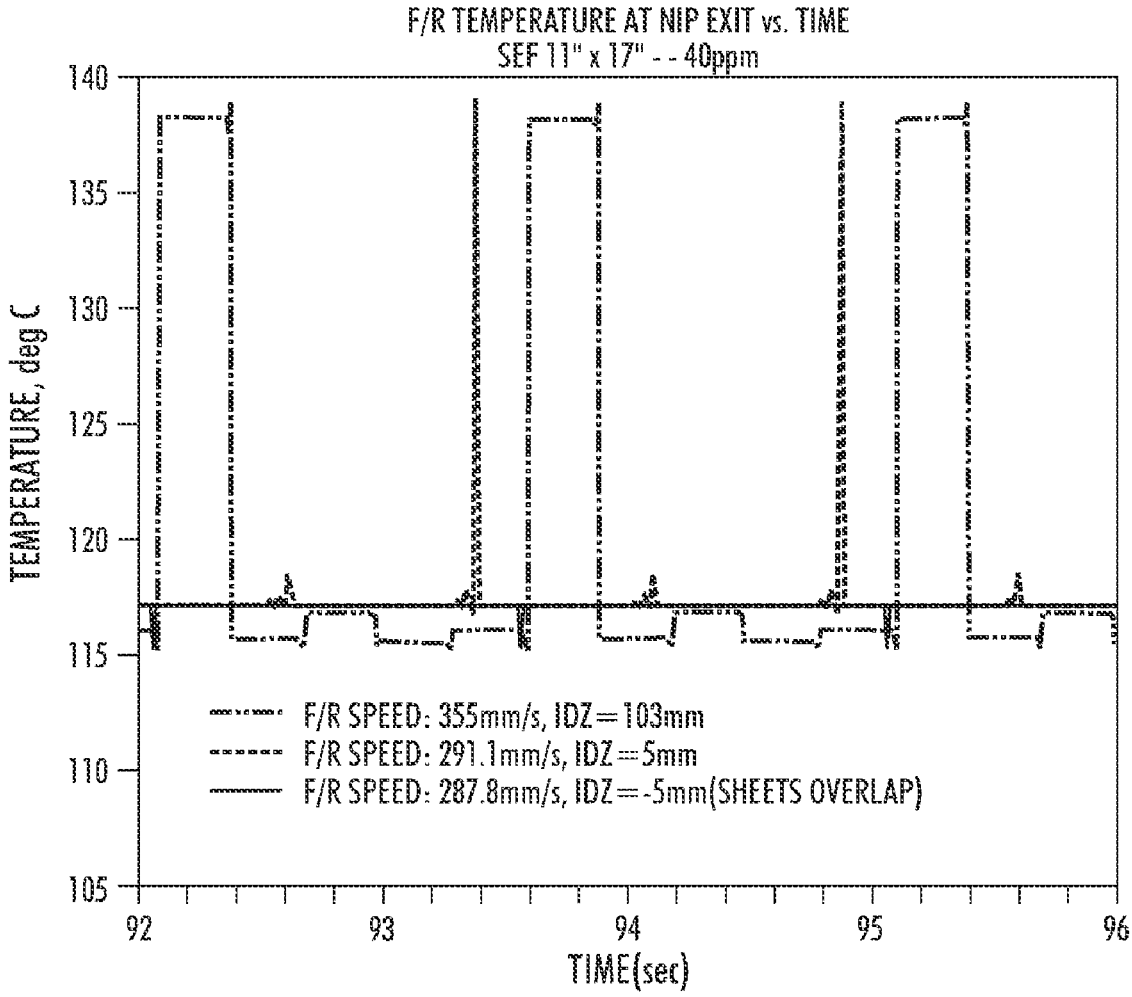
FIGS. 3 and 4 show numerical simulation data of fuser temperature as a function of time at Nip exit and Nip entrance where one can see the benefits of employing the media transport of the present disclosure.
Figure 4:
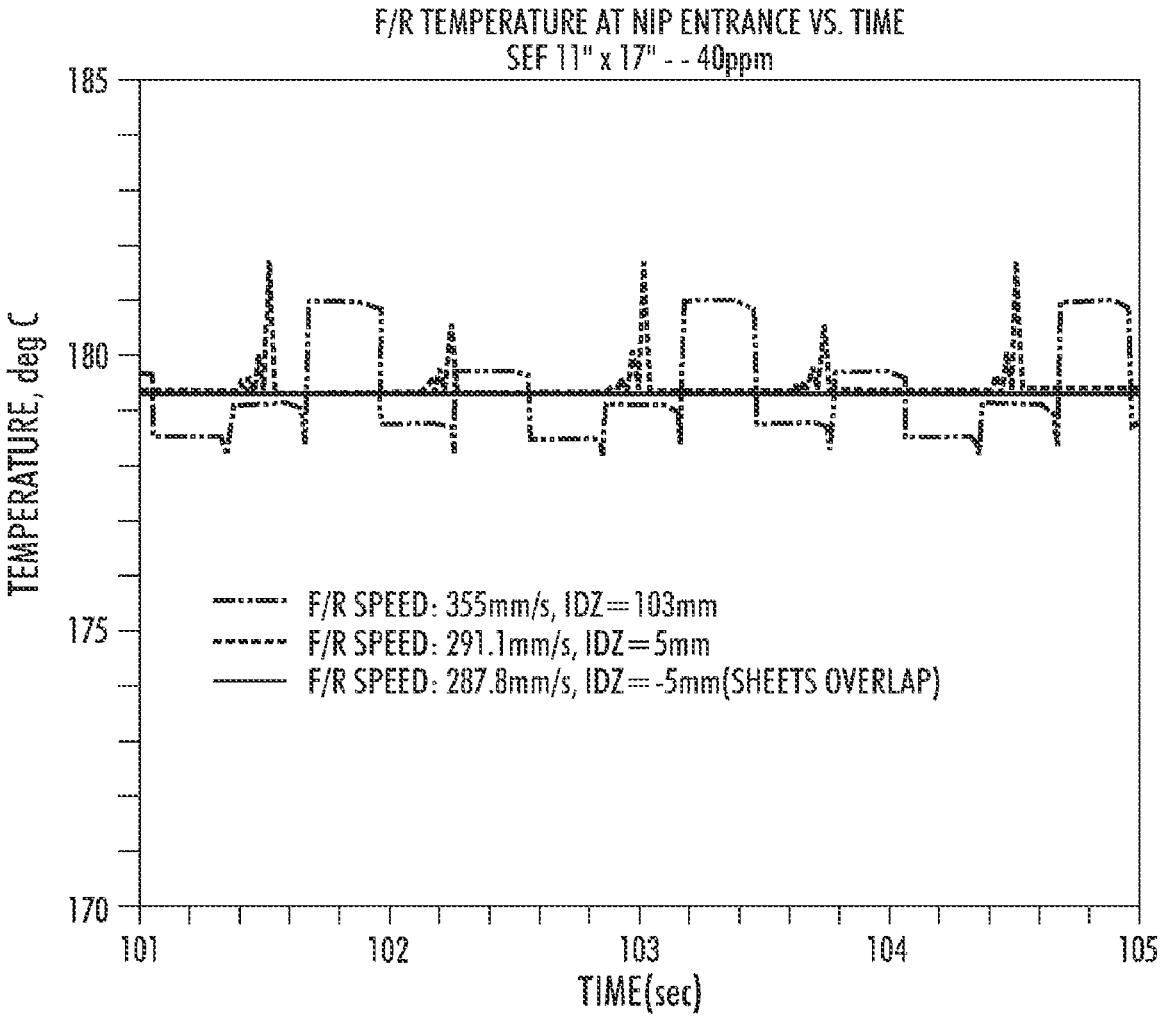

Principles of the present invention were tested using a thermal simulation model of the preheat transport module of the type of the present disclosure. FIGS. 3 and 4 illustrate results thereof. The figures show time traces of the fuser roll temperature at the exit of the nip and at the entrance of the nip respectively. FIGS. 3 and 4 compare the fuser roll temperature for three cases: (a) Inter-document zone length=103 mm, (b) Inter-document zone length=5 mm, (c) Inter-document zone length=−5 mm (overlap). FIGS. 3 and 4 clearly show that overlapping is a very effective way of eliminating temperature variations on the fuser surface, which in turn will result in less gloss variation on prints.

It is, therefore, apparent that there has been provided in accordance with the present invention a paper transport module that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

It will be appreciated that various embodiments of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method for reducing temperature variations on a fuser surface to reducing gloss variation in prints, in an electrostatic printing system having the fuser for fusing sheets having marking particles thereon, the method comprising:

transporting a first sheet to the fuser;

transporting a second sheet to the fuser;

abutting a trailing edge of the first sheet to a leading edge of the second sheet prior to the trailing edge of the first sheet entering the fuser; and separating the trailing edge of the first sheet to a leading edge second sheet when said first sheet exits the fuser.

2. The method of claim 1, wherein said abutting includes sensing trailing edge of the first sheet and leading edge of the second sheet and varying a speed of the second sheet relative to the first sheet, in response to sensing, so that the trailing edge of the first sheet and the leading edge of the second sheet abut each other prior to the trailing edge of the first sheet entering the fuser.

3. The method of claim 1, wherein said abutting includes sensing trailing edge of the first sheet and leading edge of the second sheet and varying the speed of the first sheet relative to the second sheet, in response to sensing, so that the trailing edge of the first sheet and the leading edge of the second sheet abut each other prior to the trailing edge of the first sheet entering the fuser.

4. The method of claim 1, wherein said abutting further includes overlapping the trailing edge of the first sheet and the leading edge of the second sheet with a predefined overlap.

5. The method of claim 4, wherein said overlapping includes lowering the trailing edge of the first sheet in respect to the leading edge of the second sheet.

6. The method of claim 4, wherein said predefined overlap is between 1 mm to 5 mm.

7. The method of claim 4, including further passing said predefined overlap through the fuser at a predefined speed.

8. The method of claim 4, wherein a predefined speed is substantially constant.

9. The method of claim 4, wherein said transporting includes employing a plurality of sheet transporters to transport sheets to the fuser.

10. The method of claim 9, wherein said transporting includes independently controlling a speed of each of said plurality of sheet transporters.

11. A method for reducing gloss variation in prints, in an electrostatic printing system having a fuser for fusing sheets having marking particles thereon, the method comprising:

transporting a first sheet to the fuser;

transporting a second sheet to the fuser; and abutting a trailing edge of the first sheet to a leading edge of the second sheet prior to the trailing edge of the first sheet entering the fuser and wherein said first sheet is accelerated to a higher speed after exiting the fuser to provide separation between said first sheet and said second sheet.

* * * * *